US011560993B2

(12) United States Patent
Gindele et al.

(10) Patent No.: US 11,560,993 B2
(45) Date of Patent: Jan. 24, 2023

(54) LIGHT CONVERSION DEVICES AND LIGHTING DEVICES

(71) Applicant: SCHOTT AG, Mainz (DE)

(72) Inventors: Frank Gindele, Schweitenkirchen (DE); Edgar Pawlowski, Stadecken-Elsheim (DE); Christian Rakobrandt, Schwindegg (DE); Christoph Stangl, Buch am Erlbach (DE)

(73) Assignee: SCHOTT AG, Mainz (DE)

( * ) Notice: Subject to any disclaimer, the term of this patent is extended or adjusted under 35 U.S.C. 154(b) by 0 days.

(21) Appl. No.: 16/989,656

(22) Filed: Aug. 10, 2020

(65) Prior Publication Data

US 2021/0041074 A1 Feb. 11, 2021

(30) Foreign Application Priority Data

Aug. 9, 2019 (DE) ..... 10 2019 121 511.0

(51) Int. Cl.

| | |
|---|---|
| ***F21S 41/176*** | (2018.01) |
| ***F21S 41/16*** | (2018.01) |
| ***F21S 45/47*** | (2018.01) |
| ***F21S 41/20*** | (2018.01) |

(52) U.S. Cl.

CPC ..... *F21S 41/176* (2018.01); *F21S 41/16* (2018.01); *F21S 41/285* (2018.01); *F21S 45/47* (2018.01)

(58) Field of Classification Search

CPC ..... F21S 41/176; F21S 41/16; F21S 45/47; F21S 41/285

See application file for complete search history.

(56) References Cited

U.S. PATENT DOCUMENTS

| | | | | |
|---|---|---|---|---|
| 4,458,683 | A * | 7/1984 | Saito | A61B 18/22 606/3 |
| 10,222,019 | B1 * | 3/2019 | Li | F21S 41/645 |
| 2005/0214573 | A1 * | 9/2005 | Den | H05B 33/14 428/690 |
| 2012/0230007 | A1 * | 9/2012 | Kawakami | F21S 41/176 362/19 |
| 2014/0169024 | A1 | 6/2014 | Hager | |
| 2017/0198876 | A1 | 7/2017 | Boinet | |
| 2017/0210277 | A1 | 7/2017 | Harada | |
| 2017/0210280 | A1 | 7/2017 | Suzuki | |
| 2017/0307163 | A1 * | 10/2017 | Nagasaki | F21S 41/176 |
| 2018/0363860 | A1 * | 12/2018 | Kasugai | F21K 9/64 |

(Continued)

FOREIGN PATENT DOCUMENTS

| | | |
|---|---|---|
| CN | 106939991 | 7/2017 |
| DE | 102012223854 | 6/2014 |

(Continued)

*Primary Examiner* — Jong-Suk (James) Lee
*Assistant Examiner* — Christopher E Dunay
(74) *Attorney, Agent, or Firm* — Ruggiero McAllister & McMahon LLC

(57) ABSTRACT

Lighting devices for providing a secondary light with high luminance are provided. The lighting devices include a light conversion element and a light emitting unit with a light source that emits a primary light. The light conversion element has a front side illuminated with the primary light and, in response to the primary light, to emit a secondary light from the front side. The secondary light has a larger wavelength than the primary light.

21 Claims, 5 Drawing Sheets

(56) References Cited

U.S. PATENT DOCUMENTS

| | | | | |
|---|---|---|---|---|
| 2019/0032878 | A1 | 1/2019 | Muster | |
| 2019/0170314 | A1* | 6/2019 | Lenef | H01S 5/0071 |
| 2019/0219248 | A1* | 7/2019 | Patent | F21S 41/176 |
| 2019/0390835 | A1* | 12/2019 | Goldmann | F21V 9/30 |
| 2020/0141551 | A1 | 5/2020 | Seidl | |
| 2020/0263846 | A1* | 8/2020 | Miu | B60Q 1/04 |
| 2020/0263850 | A1 | 8/2020 | Kawaguchi | |

FOREIGN PATENT DOCUMENTS

| | | |
|---|---|---|
| DE | 102018127831 | 5/2020 |
| EP | 3184884 | 6/2017 |
| EP | 3203140 | 8/2017 |
| EP | 3396230 | 10/2018 |
| WO | 2017104167 | 6/2017 |
| WO | 2017111405 | 6/2017 |
| WO | 2017133809 | 8/2017 |
| WO | 2017157705 | 9/2017 |

* cited by examiner

LIGHT CONVERSION DEVICES AND LIGHTING DEVICES

CROSS REFERENCE TO RELATED APPLICATIONS

This application claims benefit under 35 USC § 119 of German Application 10 2019 121 511.0 filed Aug. 9, 2019, the entire contents of which are incorporated herein by reference.

BACKGROUND

1. Field of the Invention

The invention relates to a lighting device, a light conversion device, and a method for the production thereof.

2. Description of Related Art

Lighting devices in different designs are known, such as, for example, so-called discharge lamps and halogen lamps. However, for various reasons—for example, in order to increase energy efficiency or in order to provide lighting devices that require little space and, at the same time, preferably provide a high luminance—lighting devices based on laser light sources are of increasing interest. Usually, they are built in such a way that they comprise at least one laser light source, such as, for example, a laser diode, as well as a light conversion element.

The light conversion element serves for the purpose of receiving the light of the laser light source and of emitting it again at another wavelength, because the light emitted from the laser light source or from the laser light sources usually does not have the desired color location or color coordinates, such as, for example, color-neutral "white" color coordinates. After it has been irradiated with the light of the laser light source or of the laser light sources, which is usually monochromatic, the light conversion element is able to convert this light partially or completely into another wavelength or a plurality of other wavelengths or into a specific wavelength spectrum. For example, light with a wavelength of 450 nm in the case of a blue laser can be employed. In this case, through additive color mixing of the scattered light and the converted light, it is possible to produce a light image that has desired or specified color coordinates.

Described in the unexamined published German Application DE 10 2012 223 854 A1 is a remote phosphor converter device, which comprises a holder and a converter element held by this holder, as well as a primary light emitting element, which is configured in such a way that a primary light emitted by it can be directed onto the converter element.

US Publication US 2017/0210277 A1 describes a semiconductor LED device for which the luminance in a longitudinal direction slightly decreases.

US Publication US 2017/0210280 A1 describes a headlight device for vehicles, which is configured so that it is possible to adjust different light distribution patterns.

US Publication US 2017/0198876 A1 describes a lighting device that is equipped with a curved light conversion element as well as a vehicle headlight comprising such a lighting device.

A method for controlling a motor vehicle headlight and a corresponding motor vehicle headlight are disclosed in European Application EP 3 184 884 A1. The motor vehicle headlight comprises at least one laser diode and a light conversion element associated with the laser diode. Regions of the light conversion element that correspond to different regions of the light image can be illuminated by a laser beam of the laser diode periodically and with differing intensity, so that the lighting intensity can be adjusted in different regions of the light image by way of the relative illumination duration and/or by way of the different light intensities of the laser diode in these regions.

International Patent Application WO 2017/133809 A1 describes an illumination device for the emission of illumination light. The illumination device comprises an LED for the emission of LED radiation and a laser for the emission of laser radiation as well as a luminescent element for at least partial conversion of the LED radiation and the laser radiation into a conversion light. During operation of the lighting device, the regions overlap at least partially on the luminescent element onto which LED light and laser light are radiated.

European Application EP 3 203 140 A1 describes a lighting device for a vehicle and an associated operating method. The lighting device comprises a pixel light source as well as an anamorphic element that can be illuminated at least partially with a light distribution by the pixel light source.

Chinese Application CN 106939991 A describes a vehicle headlight that is based on the laser excitation of a fluorescent optical fiber, comprising a laser module, an optical fiber, and a fluorescent optical fiber. In this way, a vehicle headlight with a compact construction is provided.

International Application WO 2017/111405 A1 describes a phosphor plate arrangement, an arrangement for the emission of light, as well as a vehicle headlight that comprises these arrangements.

International Application WO 2017/104167 A1 describes an illumination device and a vehicular headlight. The illumination device comprises a device for the emission of light using a luminescent substance that emits light when it is excited by light of the laser element as well as a movable mirror that moves continuously according to a predetermined routine

SUMMARY

The light conversion element is also referred to as a converter, such as, for example, Ce:YAG, luminescent element, or (English) phosphor, whereby the term "phosphor" is not intended to be understood here in the sense of the chemical element of the same name, but rather relates to the property of this substance to luminesce. In the sense of the present disclosure, therefore, the term "phosphor" is always understood to mean a luminescent substance, and not the chemical element of similar name, unless explicitly stated otherwise.

Such lighting devices based on laser light sources are especially important, because, in this way, it is possible to achieve a high luminance or light density (English: luminance), which can be relevant, in particular, for applications in the automobile sector.

It is a goal of the present invention to achieve an especially high luminance, and also specially to obtain it with low laser power, in order to achieve not only a high luminance, but also to keep power consumption as low as possible. This can be achieved by producing a light spot of only small dimension, such as, for example, of only small diameter—for example, smaller than 500 micrometers—but with a correspondingly high luminance.

The phosphor used can, on the one hand, be operated in transmittance and, on the other hand, also in remission (reflectance) mode. In remission use, the phosphor can be cooled from the back side.

In known laser white light sources, the color coordinates realized are often "blue-shifted," so that the color coordinate value realized is not usable as needed or a desired color coordinate value cannot be realized as needed.

However, it has been found that lighting devices that can be found in the prior art do not allow an adequately high luminance to be realized. Therefore, at least in terms of the achievable luminance, the known lighting devices are worthy of further improvement.

Therefore, an object of the invention is to improve the prior art. A lighting device and a light conversion device suitable for it shall be presented, which make it possible to increase the luminous efficacy and the efficiency and thus to reduce power consumption and/or to increase the emitted amount of light that can be used. The lighting device should preferably make possible the emission of white light and still more preferably the emission of light in the ECE color coordinate field.

For this purpose, the idea of producing or providing a light spot that has a high or higher luminance is pursued.

The light conversion device according to the invention for providing a secondary light with high luminance comprises a light conversion device with a light conversion element, wherein the light conversion element has a front side and is configured to be illuminated on the front side with primary light and, on the same front side, to emit secondary light having another wavelength or having another wavelength range in response to the primary light. In other words, the light conversion element is operated in remission. The light conversion element is therefore designed, in particular, for a remission operation (reflectance operation). This remission arrangement also has advantages in terms of structural engineering, since it is thereby possible to cool the light conversion element from the back side by means of a base body designed as a cooling body, for example.

Furthermore, the lighting device comprises a light emitting unit having at least one light source, which is configured so as to provide the primary light for illuminating the front side of the light conversion element. In a preferred example, the light emitting unit comprises a diode laser, which is appropriately conditioned and is directed at the light conversion element.

The light conversion element comprises a material that, by means of scattering, absorption, and/or conversion of the incident beam of primary light, emits the secondary light. In this case, the secondary light comprises a longer wavelength than that of the primary light. The secondary light is therefore, for example, a light of longer wavelength than that of the primary light. The secondary light can also comprise a wavelength range, whereby the wavelength range of the secondary light can be greater than the wavelength range of the primary light. In other words, in the light conversion element, a conversion of the primary light takes place toward a longer wavelength or toward a spreading of the wavelength range, in particular in combination with a monochromatic light source such as a laser. As material for this, the light conversion element comprises, in particular, YAG.

The light conversion element is arranged in the beam path of the light source. This means that the light source forms with the primary light an optical axis and that the light from the light source is beamed along the optical axis onto the light conversion element. When the light source is not punctiform, the light from the light source can also comprise an angular range from which the primary light is beamed onto the light conversion element.

The primary light is thus guided onto a primary light receiving surface on the front side, within which the light conversion element is illuminated with the primary light. In other words, the primary light receiving surface describes that surface area on which the primary light enters the light conversion element.

In response to the illumination with primary light, the front side provides a primary light emitting surface. This means that the light conversion element reemits a portion of the incident beam of primary light by reflectance at the front side of the light conversion element, for example. Typically emitted from the primary light emitting surface is therefore light of a wavelength identical to the wavelength of the primary light—or light of the same wavelength range as the wavelength range of the primary light. The primary light emitting surface can be larger than the primary light receiving surface.

The front side further provides a secondary light emitting surface, within which the light conversion element emits the secondary light. In other words, the secondary light is emitted from the secondary light emitting surface. The secondary light emitting surface thus typically provides light of a longer wavelength than the wavelength of the primary light or the secondary light emitting surface provides light of a wavelength range, whereby the wavelength of the wavelength range of the secondary light is typically longer than the primary wavelength of the primary light. The secondary light emitting surface can be larger than the primary light emitting surface.

The primary light receiving surface has a diameter; for example, the primary light receiving surface is round or oval. Furthermore, the light conversion element has a thickness. Within the framework of deriving the present invention, it was then proven to be advantageous when the diameter of the primary light receiving surface in relation to the thickness of the light conversion element is preferably in the ratio of 2:1 or less, more preferably 1:2 or less, preferably 1:3, more preferably 1:4. In other words, this means that the diameter of the primary light receiving surface is half as great as the thickness of the light conversion element, preferably a third, and more preferably a fourth of the thickness of the light conversion element or less.

The fact that a relationship between the diameter of the primary light receiving surface and the thickness of the light conversion element is relevant was found in the course of developing the invention. Thus, the diameter of the primary light receiving surface cannot be arbitrarily reduced in size, in order to increase the luminance in this way. This is based in part on the fact that, for luminances that are desired and are to be achieved, the light conversion element undergoes a thermal heating, and this can result in a thermal quenching as needed. This process, which is also referred to as fluorescence quenching, results in a decrease in the intensity of the fluorescence of a fluorophor, that is, of the light conversion element. It may be assumed that dynamic quenching or collisional quenching is thereby provoked. In order to prevent this undesired decrease in the intensity, it is advantageous to cool the light conversion element. In this case, in an especially advantageous manner, the outcome can be further improved when the cooling of the light conversion element is improved. Thus, in the scope of the invention, it could be found that the ratio between luminous efficacy and heating of the light conversion element—and hence its cooling, which is associated therewith—is especially advantageous when the aforementioned ratios between the diameter of the primary light receiving surface and the thickness of the light conversion element preferably lie in the range of 2:1 or less.

In other words, the obtainable cooling power, for example, depends on the magnitude of the diameter of the primary light receiving surface, wherein a lesser cooling power is obtainable in the case of a larger diameter of the primary light receiving surface. In the case of non-round shapes of the primary light receiving surface—for example, elliptical primary light receiving surfaces—the surface area can be calculated and from this an "equivalent diameter" can be calculated that is present for the same surface area of a round, circular surface. It is thus physically more exact that the obtainable cooling power is dependent on the size of the surface of the primary light receiving surface. The obtainable cooling power further depends on, for example, the thickness of the light conversion element, in particular in the region or at the site of the primary light receiving surface for the case when the light conversion element does not have a constant thickness. It has been shown here that, for example, a ratio of the diameter (or equivalent diameter) of the primary light receiving surface to the thickness of the light conversion element of 2:1 or less, preferably 1:1 or less, 1:2 or less, 1:3 or less, more preferably 1:4 or less is preferably adjusted. Then a sufficient cooling power can be provided, for example, in order to thus further increase the obtainable luminance, and to prevent potential mechanisms that increase loss, such as, e.g., thermal quenching. It is possible in this case to select the primary light receiving surface as small, such that thermal quenching already is occurring in its central region, whereby then, if just the beginning of thermal quenching is provoked in the central region of the primary light receiving surface, a luminance that is as high as possible can be obtained.

The emission of secondary light from the lighting device can be limited to a useful light spot, which comprises only a partial surface area of the secondary light emitting surface. In other words, the total amount of secondary light is not utilized for the formation of the useful light beam. This can be advantageous when the secondary light exits the light conversion element in a greater range of the angle of emission and, for example, a secondary optics is utilized in order to form the useful light beam. The secondary optics can then take up a subsector of the solid angle of the secondary light beam.

For producing an especially high intensity or luminous efficacy from the light conversion element, it has proven advantageous when the luminance of the secondary light is at least 1000 cd/mm$^2$ or more, preferably at least 1100 cd/mm$^2$, more preferably at least 1200 cd/mm$^2$. Furthermore, in this case, different configurations are also presented as to how it is possible to increase the luminance of the secondary radiation to such high values, not previously achieved, of over 1000 cd/mm$^2$.

The light conversion device is preferably configured in such a way that, depending on the direction of the incident or emitted beam of light, respectively, into or out of the light conversion element, it has a different degree of reflectance, which is preferably a function of the wavelength.

Furthermore, the light conversion element can be configured so as to receive blue primary light on its front side, to convert the blue primary light to white secondary light, and to emit the white secondary light on its front side on the secondary light emitting surface. The blue primary light can be provided, in particular, in a narrow wavelength range around 450 nm, such as, for example, 450±10 nm or 450±5 nm.

Furthermore, the light emitting unit of the lighting device can comprise at least one laser light source, in particular a diode laser. Such a diode laser can have, for example, a laser power of between 0.1 to 10 watts, preferably 1 to 10 watts, more preferably 5 to 8 watts.

Furthermore, the light emitting unit of the lighting device can comprise at least one additional laser light source or an arrangement composed of laser light sources, preferably diode lasers. In other words, it is possible to form a plurality of laser light sources, which are directed simultaneously at the light conversion element and jointly illuminate the light receiving area. The at least two laser light sources or the plurality of laser light sources or the arrangement thereof preferably has a total laser power in the range between 0.1 to 100 watts, for example, in the range between 0.1 to 10 watts Furthermore, the lighting device can comprise an optical element or optical component between the light emitting unit and the light conversion element. The optical element can comprise a lens in order to bundle the primary light from the at least two laser light sources or the arrangement composed of laser light sources by means of the optical element so as to form or to reduce in size the primary light receiving surface on the light conversion element.

The primary light of the light emitting unit can also be distributed over a plurality of laser beams and can be directed, conveyed, or guided from various directions onto the light conversion element in order to form jointly the primary light receiving surface or to be directed onto a common primary light receiving surface.

The light emitting unit can comprise one light guide or a plurality of light guides, in particular fiber optic light guides. The light guides can be configured so as to emit the primary light for the illumination of the light conversion element. In other words, the laser light source couples the light into the light guide or light guides, which is or are directed at the primary light receiving area. In the case of a plurality of beams of primary light, either from a plurality of different light sources or distributed from a single light source, the light guides can combine the plurality of beams of primary light in a light guide in order to illuminate the primary light receiving surface and, in particular, to reduce it in size.

The lighting device preferably comprises a base body, which, in particular, is designed as a cooling body having at least one cooling element. The base body has a front side and the light conversion element is placed on the front side of the base body. The base body can serve, for example, to fasten or fix the light conversion device in a lighting device and, for this purpose, can have fastening means.

In a preferred embodiment, the base body can comprise a reflector on its back side, in particular a metallic reflector. By means of the reflector on its back side, it is possible to improve the dissipation of heat in the lighting device and thereby to reduce the operating temperature of the light emitting unit. In other words, the base body can be cooled efficiently by means of the reflector on the back side. For this purpose, furthermore, the reflector on the back side of the base body can be materially bonded to a heat sink, such as, for example, a copper heat sink. A fluid can also be circulated around the reflector in order to improve the heat dissipation away from the light conversion element.

The light conversion element can be arranged directly or indirectly on the base body. In the case that the light conversion element is placed indirectly on the base body, it is possible, for example, for the light conversion device to comprise an intermediate element that is placed on the base body and on which, in turn, the light conversion element is arranged. Such an intermediate element can also be designed as an aligning element in such a way that it enables an alignment of the light conversion element relative to the primary light and/or an alignment of the secondary light relative to a downstream optics.

The lighting device can further comprise a secondary optics arranged downstream of the light conversion element for capturing, and in particular for shaping, the secondary light, and for emitting the secondary light.

The light emitting unit can be arranged in such a way that the primary light is irradiated laterally onto the light conversion element. In other words, the primary light is irradiated onto the front side of the lighting device, and in fact at an angle that is different from zero to an axis of the normal line of the light conversion element. Thus, the light emitting unit(s) can be arranged displaced laterally from the beam path of the secondary light; therefore, the beam path of the secondary light cannot be distorted by the light emitting unit, but nevertheless, an irradiation of the primary light onto the front side of the light conversion element can be obtained.

The primary light can be irradiated, in particular, along an optical axis that has an angle in relation to the axis of the normal line of the light conversion element and/or in relation to an optical axis of the secondary light, this angle being larger or equal to 20 degrees, preferably larger than or equal to 30 degrees, more preferably larger than or equal to 45 degrees, especially preferred of about 60 degrees or larger, with a scattering range or angle range as needed around the optical axis. The scattering range or angle range of the primary light around the optical axis of the primary light in this case can amount to up to ±5 degrees around the optical axis of the primary light, more preferably up to ±10 degrees around the optical axis of the primary light.

The secondary light can beam out, for example, in an angle range of greater than or equal to ±10 degrees around the optical axis, more preferably of greater than or equal to ±30 degrees, particularly preferred of greater than or equal to ±60 degrees around the optical primary light axis. The incident angle of the primary light and the emitting angle of the secondary light in this case can also overlap.

The arrangement of the light emitting unit at an angle to the normal-line axis of the light conversion element or the irradiation of the primary light onto the front side of the light conversion element at an angle that differs from the emitting angle of the secondary light has, as a further advantage, the result that reflectances at the light conversion element are not emitted together with or at a similar angle or the same angle to the secondary light from the light conversion element, but rather at an angle that differs from the emitting angle of the secondary light. For example, in the case of an incident angle of the primary radiation on the front side of the light conversion element of 60 degrees to the axis of the normal line of the light conversion element, reflected radiation can also be emitted at an angle of 60 degrees from the light conversion element, whereas the converted secondary radiation that is thus produced from the primary radiation that has penetrated into the light conversion element exits in a radiation cone from the light conversion element. The composition of the beam packet in the direction of emission of the secondary radiation is thus further improved, whereby the proportion of secondary radiation is increased.

In the case of a plurality of light emitting units, these can be arranged, for example, rotationally symmetric around the normal-line axis of the light conversion element, for example, to irradiate from two or more sides at the same or similar incident angle to the normal-line axis. Since the degree of reflectance of the front side is dependent on the incident angle, therefore, the reflectance at the front side can be selected small, and a yield of primary radiation for producing secondary radiation can be increased. On the other hand, several light emitting units can be arranged adjacent to one another and irradiated, for example, at a similar but still different incident angle to the normal-line axis.

The plurality of light emitting units here are preferably directed onto the same primary light receiving surface on the front side, so that the respective radiation intensities are additive. Also, by directing several light emitting units onto the same primary light receiving surface, the obtained luminance of the secondary radiation can be further increased, in order to obtain a luminance of over 1000 cd/mm$^2$.

The primary light receiving surface on the front side, within which the light conversion element is illuminated with the primary light, is preferably less than 1 square millimeter, preferably less than 0.5 square millimeter, more preferably less than 0.2 square millimeter.

Furthermore, the primary light emitting surface is preferably larger by a factor of 1.1 or more than the primary light receiving surface, in particular by a factor of 1.2 or more. The secondary light emitting surface is preferably larger than the primary light receiving surface and/or than the primary light emitting surface, in particular larger by a factor of 1.1 or more, preferably larger by a factor of 1.2 or more. In one example, the secondary light emitting surface comprises the entire front side of the light conversion element. In other words, the light conversion element in one example has a primary light receiving surface on its front side and a primary light emitting surface that comprises the surface area of the primary light receiving surface and is larger than the primary light receiving surface, as well as, thirdly, a secondary light emitting surface that comprises the primary light emitting surface and is larger than it.

For example, the secondary light emitting surface can enclose the primary light receiving surface. In this case, the secondary light emitting surface is at least as large as the primary light receiving surface and is arranged at the same place as the primary light receiving surface, whereby portions of the secondary light emitting surface can be arranged around the primary light receiving surface.

The light emitting unit preferably provides a monochromatic primary light or a coherent primary light with a wavelength of around 450 nm, for example, such as, for example, in a range of 450±10 nm. The light conversion element provides secondary light when it is illuminated by the light emitting unit, whereby the secondary light comprises a wavelength range in the visible light region, such as, for example, in a wavelength range from 440 to 700 nm or from 500 to 700 nm.

It is especially preferred that the emitted secondary light can lie in the ECE range with respect to the emitted wavelengths, in particular when the lighting device is in a hot operating state.

The light emitting unit can be operated, for example, with a current of at least 1800 mA, preferably of at least 2000 mA, more preferably of at least 2200 mA. In other words, the light emitting unit can be operated with a current in the range between 1800 and 2700 mA, this having proven to be especially advantageous for the desired outcome of a high luminance of the secondary light.

In an advantageous way, the light emitting unit is arranged with a light exiting surface of the light emitting unit at a distance d from the front side of the light conversion element. The distance d is then at least 200 μm, more preferably at least 230 μm, more preferably at least 250 μm.

Furthermore, the distance d can be less than 500 μm, preferably less than 450 μm, more preferably less than 400 μm. Finally, the light exiting surface can be arranged from the light emitting unit at a distance d of between 200 and 500 μm, preferably of between 230 and 450 μm, more preferably of between 250 and 400 μm.

In this way, it is possible to use the above-described measures or a combination of the above-described measures to achieve a lower power consumption in comparison to the lighting devices of the prior art as well as to achieve a very high luminance of greater than 1000 cd/mm$^2$. The lighting device is thus suitable, in particular for applications in the automobile sector, in the aircraft sector, in medical lighting, and in the general lighting sector, such as for stage lights and spotlights.

Lying in the scope of the invention is also a method for producing a lighting device for providing a secondary light with high luminance, comprising the following steps: provision of a light conversion element comprising a material that emits the secondary light by means of scattering, absorption, and/or conversion of an incident beam of primary light, wherein the secondary light comprises a longer wavelength than the primary light, or wherein the secondary light comprises a wavelength range; arrangement of a light emitting unit having at least one light source in such a manner that the light emitting unit is capable of providing the primary light for illuminating the front side of the light conversion element, which is beamed along an optical axis onto the light conversion device, wherein the light emitting unit is arranged in such a way that the primary light is directed onto a primary light receiving surface on the front side of the light conversion element, within which the light conversion element is illuminated with the primary light, wherein, on the front side, a primary light emitting surface is formed when the light conversion element is illuminated with the primary light, and wherein, on the front side, a secondary light emitting surface is formed, within which the light conversion element emits the secondary light.

BRIEF DESCRIPTION OF THE DRAWINGS

The invention will be explained in detail below on the basis of several figures.

DETAILED DESCRIPTION

Figure 1:
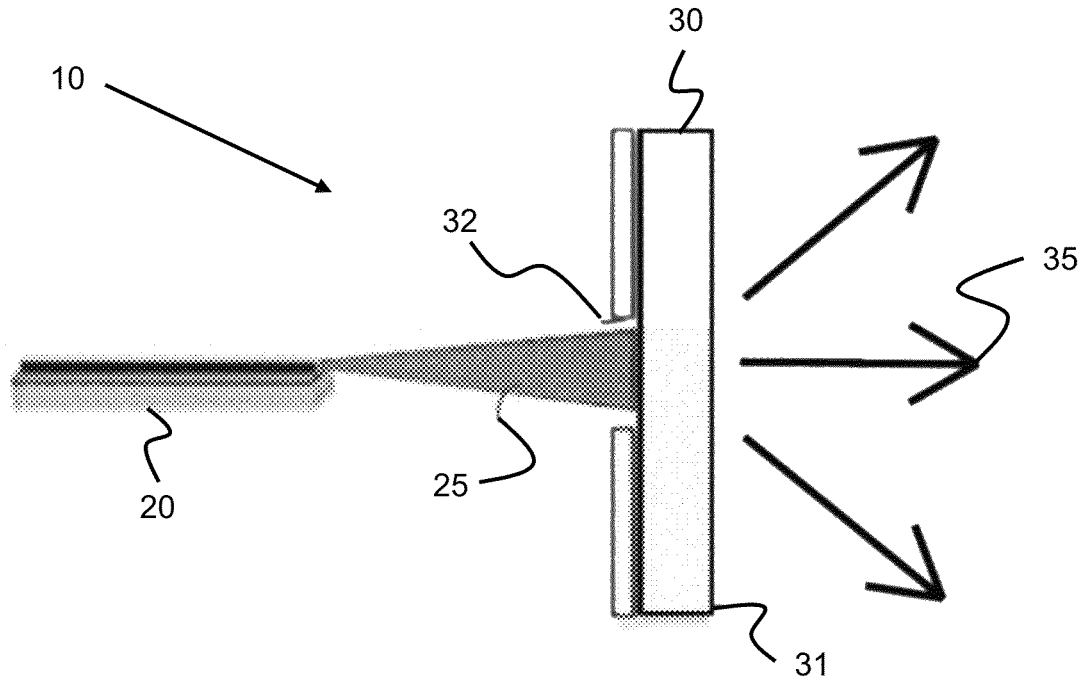
FIG. 1 a lighting device known from the prior art, in which a light conversion element (converter) is utilized in transmittance operation, FIG. 2 a lighting device in which a converter is utilized in remission operation, FIG. 3 a lighting device with cooling elements, FIG. 4 a view from the top onto a light conversion element, FIG. 5 a side sectional view of a lighting device with a plurality of light sources, FIG. 6 a side sectional view of a lighting device with a fiber element, FIG. 7 a side sectional view of a lighting device with an optical element, FIG. 8 a side sectional view of a lighting device with secondary light optics (for example, a headlight), and FIG. 9 luminances obtained using a device according to the invention.

FIG. 1 shows a known lighting device 10, which is designed for transmittance operation. The lighting device 10 comprises a light emitting unit 20, with which primary light 25 is beamed onto the back side 32 of a light conversion element 30. Accordingly, the light conversion element 30 receives the primary light 25 on the back side 32, and emits a secondary light 35 on the front side 31.

Figure 2:
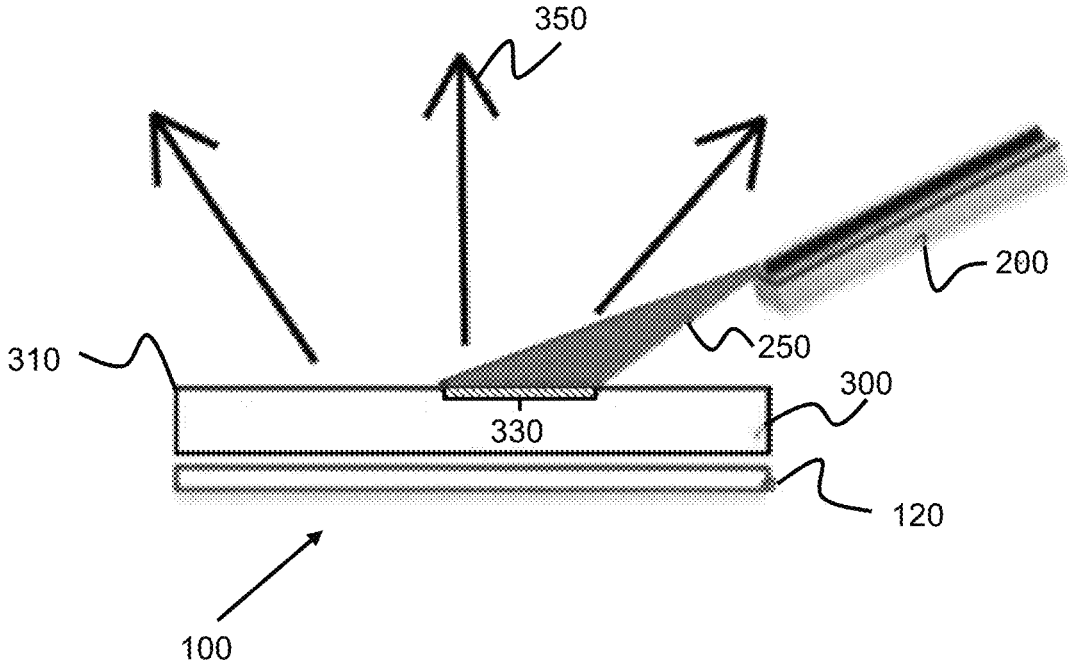

FIG. 2 shows another lighting device 100, which is designed for remission operation or reflectance operation. The light emitting unit 200 beams primary light 250 onto the front side 310 of the light conversion element 300, whereby the front side is illuminated in the region of a primary light receiving surface 330, (compare, for example, FIG. 4). The light conversion element 300 emits the secondary light 350 on the front side 310, preferably in the region of the entire front side 310 or in the region of a secondary light emitting surface 340 (see, for example, FIG. 4).

Figure 3:
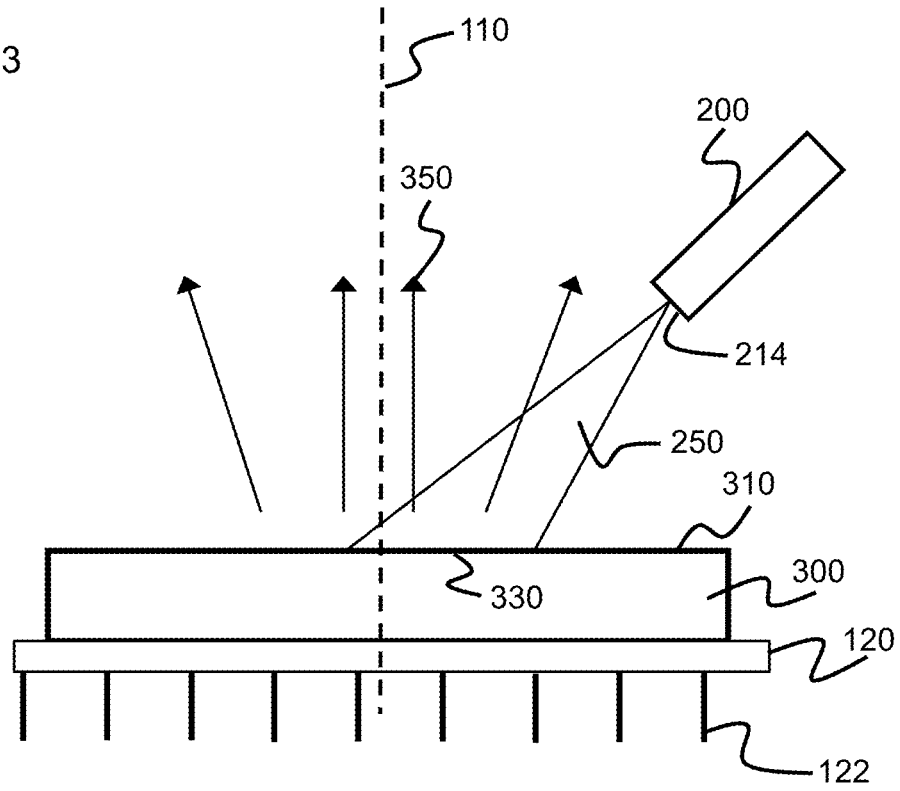

FIG. 3 shows a lighting device 100 having a light conversion element 300, which is arranged on a base body 120. On its back side, the base body 120 has cooling elements 122 in the form of cooling ribs. The light emitting unit 200 provides primary light 250, which can radiate onto the primary light receiving surface 330 on the front side 310 of the light conversion element 300. The light emitting unit 200, that is, for example, a laser light source, is arranged on the front side 310 at an angle to the normal line 110, such as, for example, at an angle of 60 degrees to the normal line 110. For example, the light also impinges at an angle to the normal line 110 on the front side of the light conversion element 300, such as, for example, in a angular range of 60±10 degrees.

Figure 4:
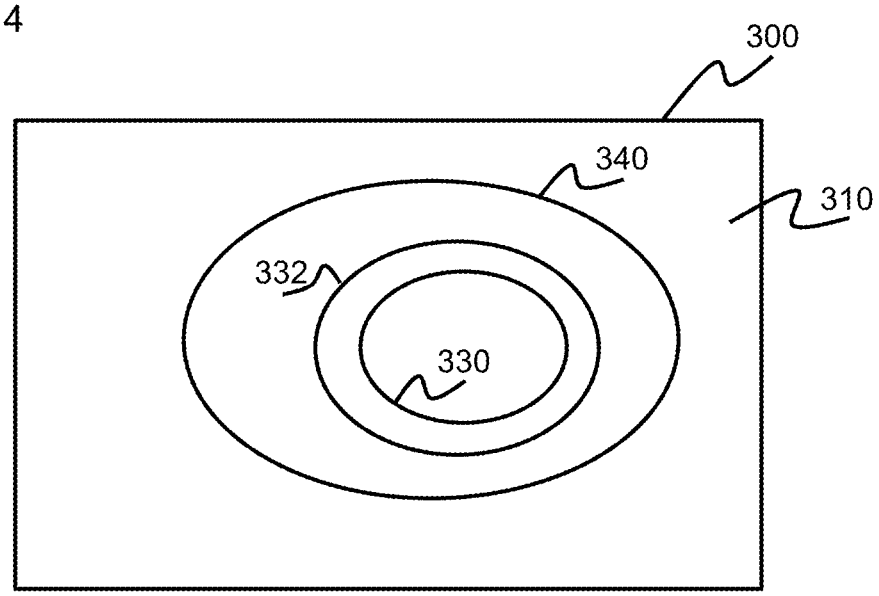

FIG. 4 shows a top view onto a light conversion element 300 with an outlined primary light receiving surface 330, a primary light emitting surface 332, and a secondary light emitting surface 340. The primary light emitting surface 332 is slightly larger and, furthermore, is configured such that the primary light emitting surface 332 completely encloses the primary light receiving surface 330. This is not necessary and is solely a readily understood design. In the region of the primary light emitting surface 332, primary light is emitted from the surface 310 of the light conversion element 300. For example, light that is emitted from the primary light emitting surface 332 is light of the same wavelength as the primary light 250 that is irradiated onto the primary light receiving surface 330 and, for example, is emitted as a beam of light at the front side 310 based on reflectance. For example, on its front side 310, the light conversion element 300 has a degree of reflectance of 2% for the incident beam of primary light 250 for the assumed angle of 60±5 degrees.

Furthermore, the secondary light emitting surface 340, within which the secondary light 350 that is produced or converted in the light conversion element 300 is emitted, is arranged on the light conversion element 300. The three outlined regions, primary light receiving surface 330, primary light emitting surface 332, and secondary light emitting surface 340, typically overlap; in one example, as is shown in FIG. 4, they are arranged so that the primary light emitting surface 332 comprises the primary light receiving surface 330, and is arranged approximately concentric thereto. Further, as is also shown in FIG. 4, the secondary light emitting surface 340 can comprise or enclose the primary light receiving surface 330 and/or the primary light emitting surface 332.

The light conversion element 300 or also the phosphor is typically provided as an yttrium aluminum garnet YAG.

Figure 5:
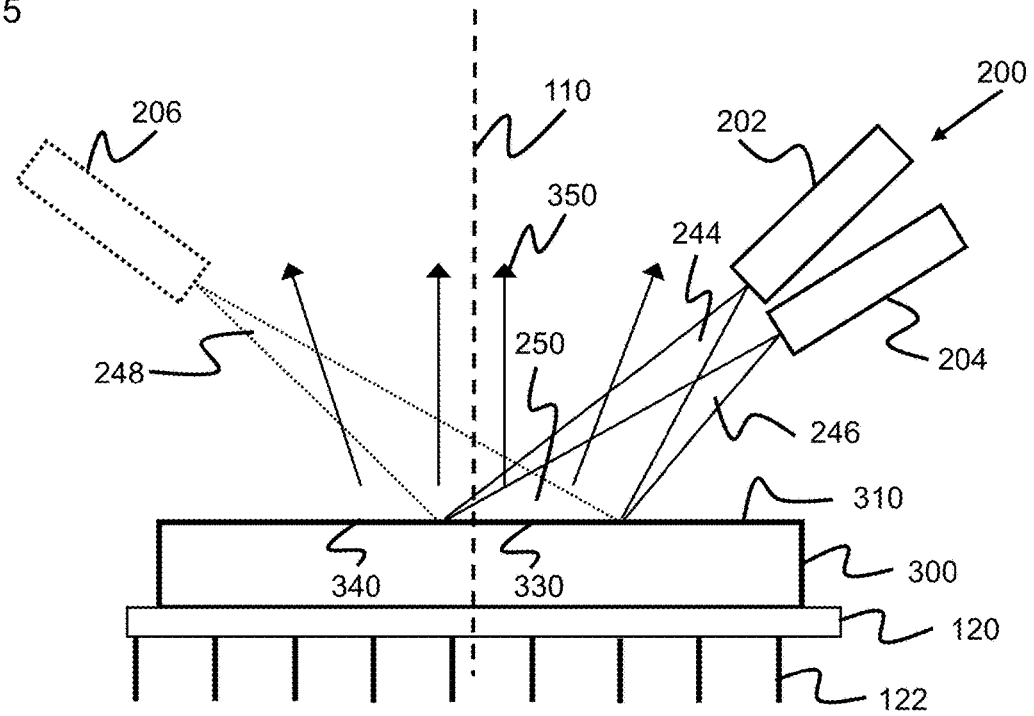

FIG. 5 shows an embodiment of the lighting device 100 having a light emitting unit 200 with a plurality of light sources 202, 204, 206, which jointly illuminate the primary light receiving surface 330. In this example, each light source 202, 204, 206 comprises a diode laser. The second diode laser 204 is arranged adjacent to the first diode laser 202 and irradiates into the light conversion element 300 at a slightly altered angle of irradiation. It is clear that the second diode laser 204 can also be arranged spatially behind the first diode laser 202 and then can irradiate a beam of light into the light conversion element 300 at an identical angle when this is advantageous. In this example, the third diode laser 206 is optional and is therefore illustrated with dotted lines; it is arranged on an opposite-lying side in relation to the first diode laser 202. In spatial arrangement, it is possible to arrange all of the light sources 202, 204, 206 in such a way that all of them irradiate a beam of light at the same angle or at a similar angle into the primary light receiving surface 330, because the degree of reflectance of the front side 310 depends on the angle of irradiation, as needed, so that, for different angles of irradiation, the degree of reflectance could increase and, as a result, more radiant power would be lost or less radiant power of the primary beam of light 250 would be available for the production of the secondary beam of light 350.

Figure 6:
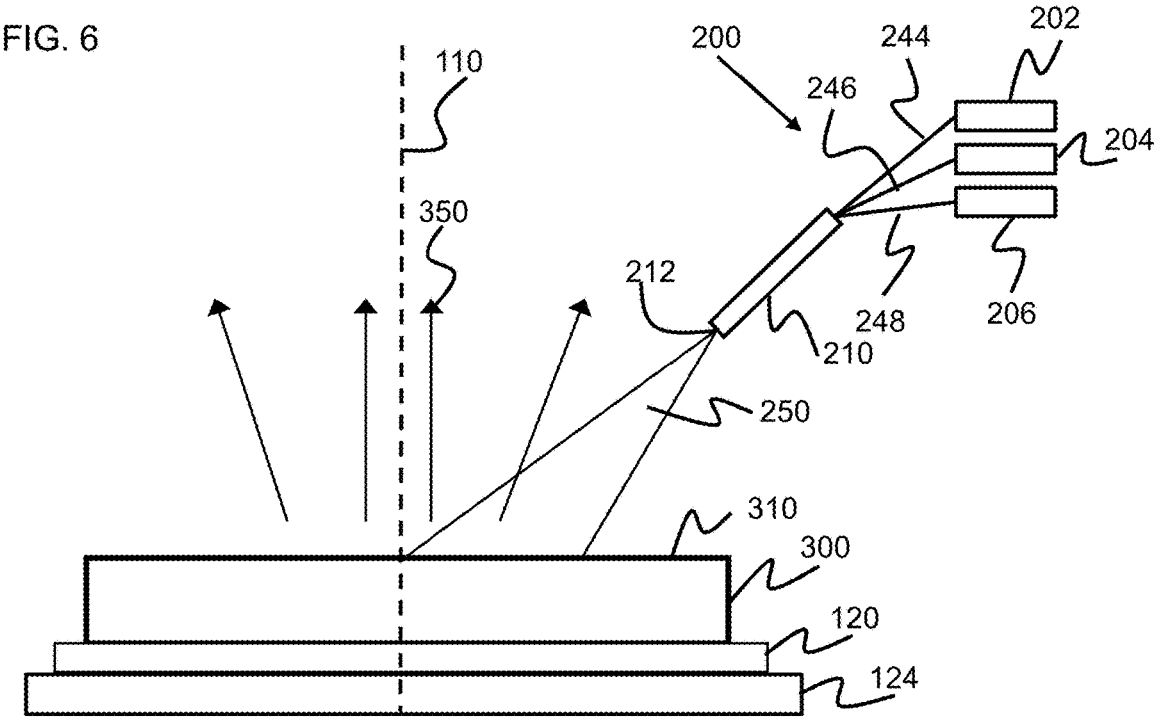

FIG. 6 shows another embodiment of the lighting device 100, whereby—as is the case for all figures of this application—it applies that the same reference numbers show the same or at least similar objects. The three light sources 202, 204, 206 of the light emitting unit 200 are arranged adjacent to one another and couple into a light guide 210. In this example, the three light sources 202, 204, 206 couple into the free beam, although an in-coupling via three separate light guides and a bundling within the light guide 210 is also technically feasible. Each of the light sources 202, 204, 206 thus emits a partial primary light 244, 246, 248, which is bundled in or bundled by the light guide 210 to form the bundled primary light 350. This bundled primary light 350 is directed from the light emitting unit 200 or from the light guide 210 onto the primary light receiving surface 330. By means of the light guide 210, it is possible to arrange the distance of the exit opening 212 of the light guide 210 even more precisely and, in particular, even closer to the front side 310 of the light conversion element 300. Thus, the light guide 210, for example, is made with a smaller diameter than that of a light source 202, 204, 206 and, for this reason, has less interference in the region of emission of the secondary beam of light 350. By means of the light guide 210, it is also possible to adjust a variable distance between the exit opening 212 of the light guide 210 and the primary light receiving surface 330 and for the distance to be variably adjustable as needed in an automated manner. Thus, through the variable adjustment of the distance d between the exit opening 212 and the primary light receiving surface 330, it is potentially possible to compensate for any shift in color or for any shifting or degrading of the power. This connection between the distance d and the emitted power of the light conversion element will be illustrated more clearly on the basis of FIG. 9.

Furthermore, FIG. 6 shows an alternative embodiment to the cooling element 122 on the back side of the base body 120. Here, it is a full-surface copper body 124 arranged for further transfer or dissipation of the heat that is introduced into the light conversion element 300. Furthermore, it would also be possible to arrange another form of cooling 122 on the back side of the base body 120, such as, for example, a fluid cooling and, for example, also a liquid cooling, in order to dissipate the heat from the light conversion element 300.

Figure 7:
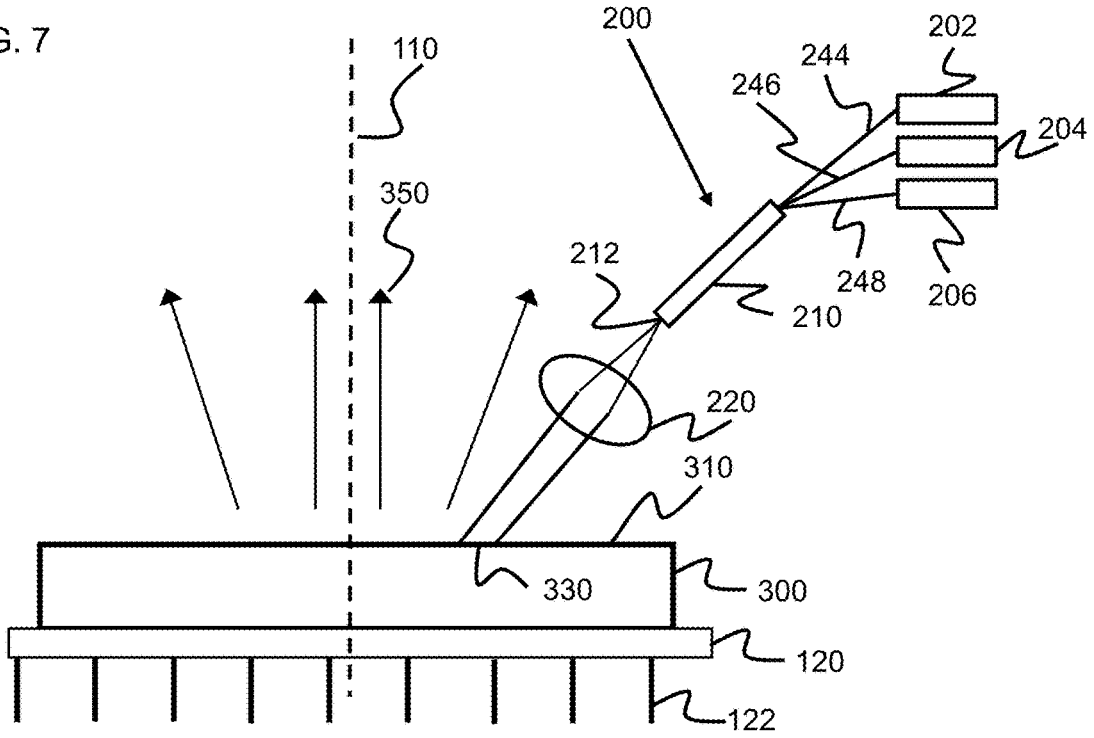

FIG. 7 shows another embodiment of the lighting device 100, whereby the light emitting unit 200 comprises a first, second, and third light source 202, 204, 206 and the light sources couple the respective partial primary light 244, 246, 248 into an optical light guide 210. An optical element 220 is consequently arranged in the exit opening 212 of the light guide in the beam path of the primary light 250 and, in this case, is a converging lens. The optical element 220 bundles the primary light 250, so that the size of the primary light receiving surface 330 on the light conversion element 300 can be adjusted or reduced in size. Through the reduction in size of the primary light receiving surface 330, it is also possible to reduce in size the secondary light emitting surface 340. The light flux of the secondary light 350 that leaves the secondary light emitting surface 340 is thereby concentrated. It is therefore possible to achieve a higher luminance of the secondary light 350.

Figure 8:
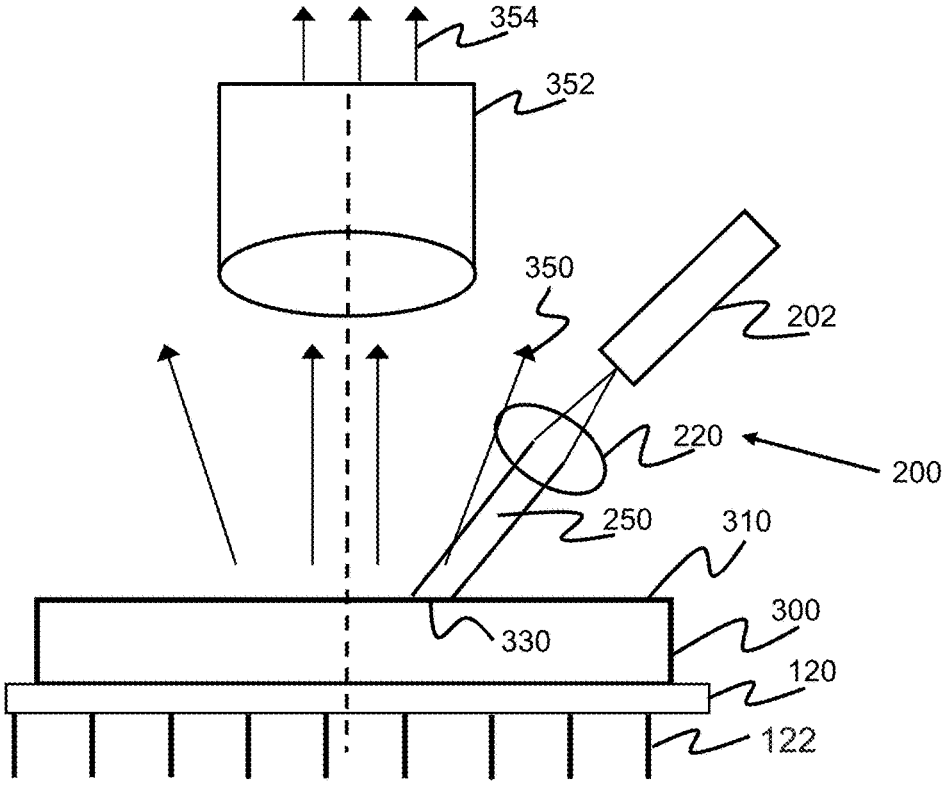

The size of the secondary light emitting surface 340 as a function of the size of the primary light receiving surface 330 can also be adjusted, however, in the case of the previously described embodiments of FIGS. 3, 5, 6 or also in the case of FIG. 8 by, for example, adjusting or altering the distance of the exit opening 214 of the light emitting unit 200 or the exit opening 212 from the light conversion element 300. Furthermore, it is also possible to fix or to influence an exit angle of the primary light 250 out of the exit opening 212, 214 in order to adjust the irradiated primary light receiving surface 330. The size of the secondary light emitting surface is also determined by, among other things, the material composition, the density, the thickness, the scattering properties, and the temperature. For example, the light emitting surface increases with increasing scattering of the material.

FIG. 8 shows yet another embodiment of the lighting device 100 having a light emitting unit 200, which comprises a laser source 202 and an optical element 220 in order to provide the high-density primary light spot 330 on the light conversion element 300. The laser source 202 is arranged in FIG. 8 in such a way that it radiates the beam of primary light 250 onto the light conversion element 300 at an angle of 60 degrees to the normal line 110.

The secondary light 350 exits from the light conversion element 300 in a large solid angle, such as, for example, in a cone-shaped solid angle that centrally encloses the normal line 110 at an angle of 30 degrees, or also, for example, 45 degrees. In this cone, which, for example, can also be 60 degrees relative to the normal line 110 or 80 degrees relative to the normal line 110, the luminous flux of the secondary beam of light 350 that is emitted from the light conversion element 300 is therefore distributed approximately uniformly. In this example, only a portion of the emitted luminous flux of the secondary beam of light 350 enters the secondary optics 352, in which the light can be further processed in order to be formed into an output beam 354, such as, for example, into a headlight beam of a motor vehicle headlight. In other words, only a portion of the amount of light 350 produced in the secondary light emitting surface 340 enters the secondary optics 352 and, accordingly, only a portion of the secondary light 350 is used for producing the output beam 354. More precisely, the secondary light 350 is directed from only a portion of the secondary emitting surface 340 into the secondary optics 352, whereas the remaining portion of the secondary emitting surface 340 radiates out a beam of the secondary light 350 in another direction, where it is not received by the secondary optics 354 and transmitted further.

Figure 9:
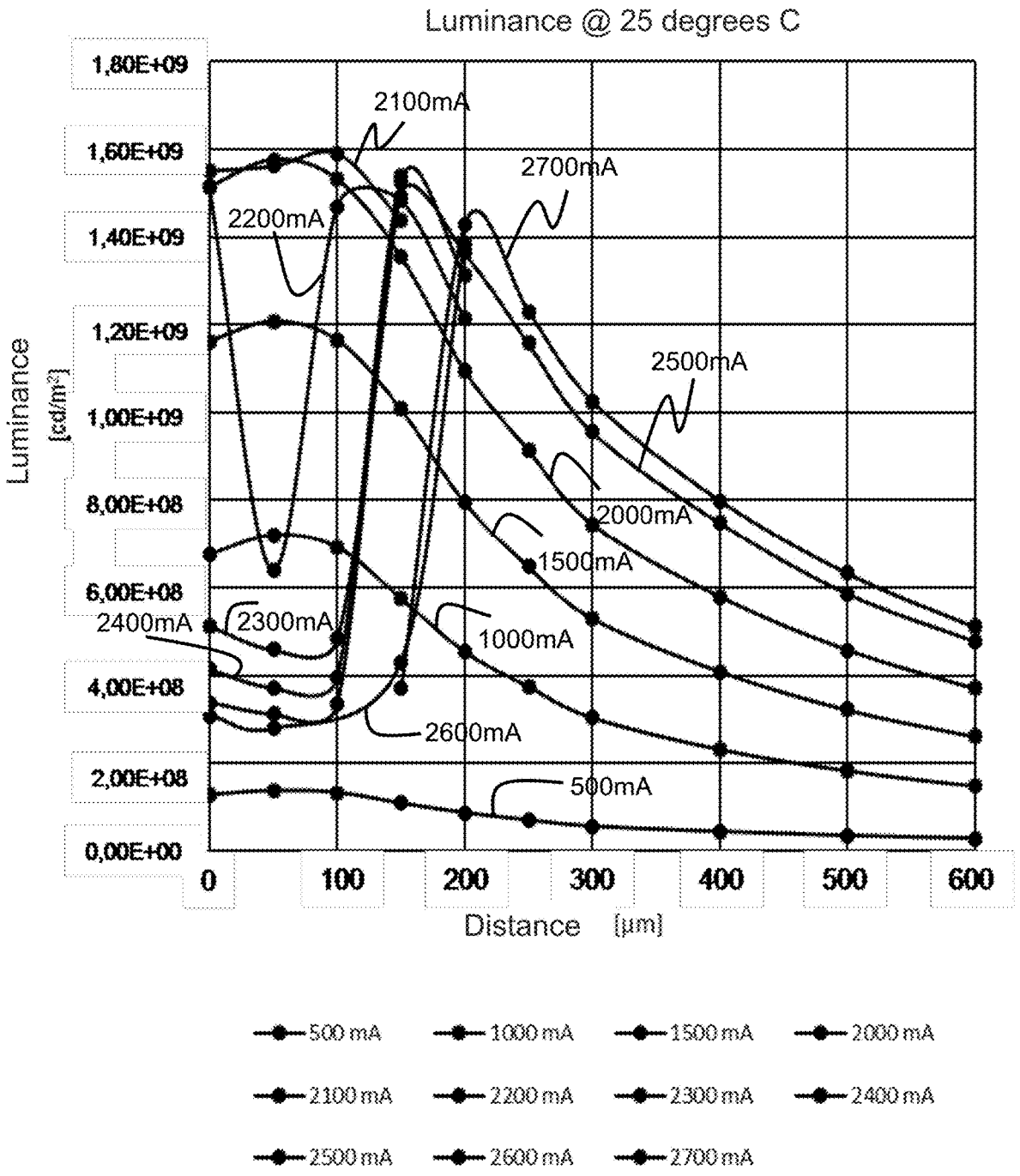

FIG. 9 shows the achievable luminances of the secondary light 350 that can be produced using a light conversion element 300 versus the distance of the exit opening 212, 214 from the primary light receiving surface 330 for different operating currents of the light emitting unit 200 used at an operating temperature of 25° C. The operating currents are 500 mA, 1000 mA, 1500 mA, 2000 mA, 2100 mA, 2200 mA, 2300 mA, 2400 mA, 2500 mA, 2600 mA, and 2700 mA. For all of the curves illustrated, it can be seen, first of all, that they show a decreasing luminance with increasing distance. This can be explained by the fact that, with increasing distance of the exit opening 212, 214 from the primary light receiving surface 330, owing to spreading of the primary light beam 250, a larger primary light receiving surface 330 is illuminated, as a result of which the produced luminance of the secondary light 350 decreases. For decreasing distance, however, at and above an operating current of 2100 mA, there results an irregular course of the curve in the direction of smaller distances, so that the luminance decreases as the distance decreases.

This can be explained by the occurrence of quenching, during which the incident energy is transformed into heat and is not available as luminosity for the secondary light 350. For various operating currents of the light source 202, it is thus possible to determine a maximum in the luminance in each case, just before the onset of quenching with a further decline in the distance. Accordingly, on the basis of FIG. 9, it is possible, in a simple way, to explain that an arbitrary increase in the operating current of the light source 202 as well as a further decrease in the distance of the exit opening 212, 214 from the primary light receiving surface 330 do not lead per se and without inventive intervention to a further increase in the luminance of the secondary light 350, but rather this is subject to physical limits, which are subject to further elaboration or exploration in an inventive way. Thus, by use of suitable parameters, it was possible in a well elaborated design, composed of the primary light emitting unit 200, the thickness of the light transformation element 300, the improvement of the cooling thereof, and the adjustment of the size of the primary light receiving surface 330, to adjust a significant increase in the luminance in comparison to known lighting assemblies. For example, by means of the lighting device described in this application, it is possible to realize a luminance in ranges of above 2000 cd/mm$^2$, preferably above 500 cd/mm$^2$, and above 800 cd/mm$^2$, and luminances of nearly 1600 cd/mm$^2$ have been achieved. A luminance in ranges of 300 cd/mm$^2$ and above seems realistic for serial operation.

It is self-evident to the person skilled in the art that the above-described embodiments are to be understood as being given by way of example and that the invention is not limited to them, but rather they can be varied in diverse ways without leaving the protective scope of the claims. Furthermore, it is self-evident that the features, regardless of whether they are disclosed in the description, the claims, the figures, or elsewhere, also individually, define key constituent parts of the invention, even when they are described jointly with other features, and can thus be regarded as having been disclosed independently of one another. In all figures, the same reference numbers represent the same objects, so that descriptions of objects that are mentioned as needed in only one figure or, in any case, not in regard to all figures, can also be extended to the figures in regard to which the object is not explicitly described in the description. The description of features of one exemplary embodiment applies appropriately in each case also to the other exemplary embodiments.

| LIST OF REFERENCE NUMBERS | |
|---|---|
| 10 | lighting device |

-continued

| LIST OF REFERENCE NUMBERS | |
|---|---|
| 20 | light emitting unit |
| 25 | primary light |
| 30 | light conversion element |
| 31 | front side |
| 32 | back side |
| 35 | secondary light |
| 100 | lighting device |
| 110 | normal line |
| 120 | base body |
| 122 | cooling element or cooling ribs |
| 124 | copper body |
| 200 | light emitting unit |
| 202 | first light source |
| 204 | second light source |
| 206 | additional light source |
| 210 | light guide |
| 212 | exit opening of the light guide |
| 214 | exit opening of the light emitting unit |
| 220 | optical element |
| 244 | partial primary light |
| 246 | partial primary light |
| 248 | partial primary light |
| 250 | primary light |
| 300 | light conversion element |
| 310 | front side |
| 330 | primary light receiving surface |
| 332 | primary light emitting surface |
| 340 | secondary light emitting surface |
| 350 | secondary light |
| 352 | secondary optics |
| 354 | output beam of light |

What is claimed is:

1. A lighting device that provides a secondary light with high luminance, comprising:

a light emitting unit with a light source and with an exit opening, the light emitting unit being configured to provide primary light along a beam path; and a light conversion element with a front side arranged in the beam path, the light conversion element being configured to, in response to the primary light, to emit the secondary light, the secondary light having a wavelength and/or wavelength range that differs from the primary light, wherein the light conversion element comprises a material that emits the secondary light via one or more of scattering, absorption, and/or conversion, wherein the front side has a primary light receiving surface where the front side is illuminated with the primary light, a primary light emitting surface that is formed when the front side is illuminated with the primary light, and a secondary light emitting surface within which the front side emits the secondary light, and wherein the light emitting unit is arranged so that the primary light is irradiated onto the light conversion element along an optical axis that has an angle greater than 60 degrees with respect to either a normal-line axis of the light conversion element or an axis of the secondary light.

2. The lighting device of claim 1, wherein the secondary light emitting surface emits light of a longer wavelength than a wavelength of the primary light, and wherein the secondary light emitting surface is larger than the primary light emitting surface.

3. The lighting device of claim 1, wherein the light conversion element comprises a ratio of a diameter of the primary light receiving surface to a thickness of the light conversion element of 2:1 or less.

4. The lighting device of claim 1, wherein the light conversion element comprises a ratio of a diameter of the primary light receiving surface to a thickness of the light conversion element of 1:4 or less.

5. The lighting device of claim 1, comprising a luminance of the secondary light that is at least 1000 cd/mm$^2$.

6. The lighting device of claim 1, wherein the light emitting unit is configured so that the primary light is blue primary light having a wavelength of 450±10 nm and the light conversion element is configured so that the secondary light is white secondary light.

7. The lighting device of claim 1, wherein the light source comprises a diode laser with a laser power in a range selected from a group consisting of between 0.1 to 100 watts, between 0.1 to 100 watts, and between 5 to 8 watts.

8. The lighting device of claim 1, wherein the light emitting unit further comprises an optical element or an optical component between the light source and the light conversion element.

9. The lighting device of claim 8, wherein the optical element or the optical component comprises a lens configured to bundle the primary light on the primary light receiving surface.

10. The lighting device of claim 1, wherein the light emitting unit further comprises a light guide configured to emit the primary light on the primary light receiving surface.

11. The lighting device of claim 10, wherein the light source comprises a plurality of light sources that are combined in the light guide to reduce a size of the primary light receiving surface.

12. The lighting device of claim 1, further comprising a base body having a cooling element on one side and the light conversion element at an opposite side.

13. The lighting device of claim 12, further comprising a reflector on the opposite side and the cooling element on the reflector.

14. The lighting device of claim 1, further comprising secondary optics downstream of the light conversion element that captures the secondary light.

15. The lighting device of claim 1, wherein the light emitting unit is arranged so that the primary light has a range of scatter around the optical axis of ±5 degrees.

16. The lighting device of claim 1, wherein the primary light emitting surface is larger by a factor of 1.1 or more than the primary light receiving surface.

17. The lighting device of claim 1, wherein the primary light emitting surface and/or the secondary light emitting surface comprises an entire area of the front side.

18. The lighting device of claim 1, wherein the secondary light, in a hot operating state of the lighting device, lies in an ECE range.

19. The lighting device of claim 1, wherein the primary light receiving surface comprises a size and wherein said size is 1 mm$^2$ or less.

20. The lighting device of claim 1, wherein reflectances at the light conversion element are not emitted together with or at a similar angle or a same angle to the secondary light from the light conversion element.

21. A lighting device that provides a secondary light with high luminance, comprising:

a light emitting unit with a light source and with an exit opening, the light emitting unit being configured to provide primary light along a beam path; and a light conversion element with a front side arranged in the beam path, the light conversion element being configured to, in response to the primary light, to emit the secondary light, the secondary light having a wavelength and/or wavelength range that differs from the primary light, wherein the light conversion element comprises a material that emits the secondary light via one or more of scattering, absorption, and/or conversion, wherein the front side has a primary light receiving surface where the front side is illuminated with the primary light, a primary light emitting surface that is formed when the front side is illuminated with the primary light, and a secondary light emitting surface within which the front side emits the secondary light, wherein the secondary light emitting surface is larger than the primary light receiving surface, and wherein the light conversion element comprises a ratio of a diameter of the primary light receiving surface to a thickness of the light conversion element of 2:1 or less.

* * * * *